US005688208A

United States Patent [19]

Plemmons

[11] Patent Number: 5,688,208

[45] Date of Patent: Nov. 18, 1997

[54] LIMB EXERCISE/THERAPY APPARATUS

[76] Inventor: David Plemmons, 19310-K One Norman Blvd., Davidson, N.C. 28036

[21] Appl. No.: 553,078

[22] Filed: Nov. 3, 1995

[51] Int. Cl.[6] ..... A63B 21/00

[52] U.S. Cl. ..... 482/44; 482/111; 601/15; 601/33; 601/166

[58] Field of Search ..... 601/15, 17, 23, 601/40, 55, 135, 148, 151, 160, 166, 154, 157; 482/44, 49, 54, 55, 111; 607/85–87, 77, 96, 104, 108, 111, 114

[56] References Cited

U.S. PATENT DOCUMENTS

| | | | |
|---|---|---|---|
| 1,740,624 | 12/1929 | Peel | 601/23 |
| 2,730,104 | 1/1956 | Newman | 601/166 |
| 3,347,240 | 10/1967 | Rigler . | |
| 3,737,073 | 6/1973 | Lupert | 222/250 |
| 3,916,537 | 11/1975 | Gilligan et al. . | |
| 3,977,396 | 8/1976 | Carter | 601/151 |
| 4,039,183 | 8/1977 | Sakurada | 482/46 |
| 4,555,236 | 11/1985 | Peyton . | |
| 4,564,956 | 1/1986 | DiBuono . | |
| 4,630,596 | 12/1986 | Hales et al. | 607/114 |
| 4,696,303 | 9/1987 | Bernardini | 607/85 |
| 4,711,445 | 12/1987 | Whitehead . | |
| 4,759,544 | 7/1988 | Diaz | 482/55 |
| 4,945,901 | 8/1990 | Burcke | 601/157 |
| 5,254,350 | 10/1993 | Barrow et al. | 424/570 |
| 5,424,088 | 6/1995 | Christianson et al. | 426/578 |
| 5,513,629 | 5/1996 | Johnson | 126/263.01 |
| 5,540,853 | 7/1996 | Trinh | 510/101 |

OTHER PUBLICATIONS

G.E. Miller, Inc. Discount Catalog 500, Spring 1995.

*Primary Examiner*—Jerome M. Clark
*Attorney, Agent, or Firm*—Carter & Schnedler

[57] ABSTRACT

There is provided an exercise/therapy apparatus for human limbs, in particularly, hands. A sealed container forming an interior space is provided having an opening therein. A glove for receiving the hand is attached to the container near the opening and extends from the opening into the interior space. A viscous material which resists the movement of the hand is received in the interior space.

19 Claims, 5 Drawing Sheets

LIMB EXERCISE/THERAPY APPARATUS

BACKGROUND OF THE INVENTION

This invention relates to an exercise and therapy apparatus. More particularly, it relates to an exercising/therapy apparatus for human limbs, such as hands.

It is desirable to exercise the muscles, tendons and ligaments of the hand and forearm after an injury or simply to strengthen the same. There are many known techniques for accomplishing this, such as, for example, squeezing a rubber ball with the hand and lifting weights and using other resistance devices. U.S. Pat. No. 4,711,445 issued to Whitehead shows a therapeutic hand exerciser in the form of a resilient polyurethane foam of a general cylindrical configuration which one squeezes with the hand. U.S. Pat. No. 3,347,240 issued to Rigler shows a heated muff hand exerciser including a cylindrical resilient compressible hand grip surrounded by electrical heating coils. While the devices shown in the Whitehead and Rigler patents, as well as a simple compressible ball, provides forms of hand exercise, they are limited to a squeezing motion and do not provide for complete exercise of the hand and forearm.

OBJECTS OF THE INVENTION

It is therefore one object of this invention to provide an improved limb exercise and therapy apparatus.

It is another object of this invention to provide an improved hand exercise and therapy apparatus.

It is still another object of this invention to provide a limb exercise/therapy apparatus which is easy to use and which permits a substantial number of exercise motions.

It is yet another object of this invention to provide a hand exercise/therapy apparatus which is suitable for use in health clubs, as well as in medical facilities.

It is another object of this invention to provide a hand exercise/therapy apparatus whereby the resistance to the motion of the hand increases proportionately to the effort of the user.

SUMMARY OF THE INVENTION

In accordance with one form of this invention, there is provided a limb exercise/therapy apparatus which includes a sealed container forming an interior space. The container has an opening therein. A sheath is attached to the container and extends from the opening into the interior space. The sheath is adapted to receive a limb, such as a human hand. A material is received in the interior space which provides a resistance to the movement of the limb.

Preferably, the material is viscous and is formed by a mixture of a solid and liquid, such as cornstarch and water. It is also preferred that the sheath is in the form of a universal glove which can accommodate either the left or right hand. In addition, it is preferred that the apparatus is mounted on a support member which elevates the apparatus to a height which is convenient for use and which enables the apparatus to be rotated in the axial direction. It is also preferred that a heat source is provided to heat the material inside the interior space so that the limb is warmed. Furthermore, it is preferred that the container have a second opening which is covered by a flexible bladder so that the pressure within the container may be regulated to control the extent of inflation of the sheath or glove.

BRIEF DESCRIPTION OF THE DRAWINGS

The subject matter which is regarded as the invention is set forth in the appended claims. The invention itself, however, together with further objects and advantages thereof may be better understood in reference to the accompanying drawings in which:

DESCRIPTION OF THE PREFERRED EMBODIMENT

Figure 1:
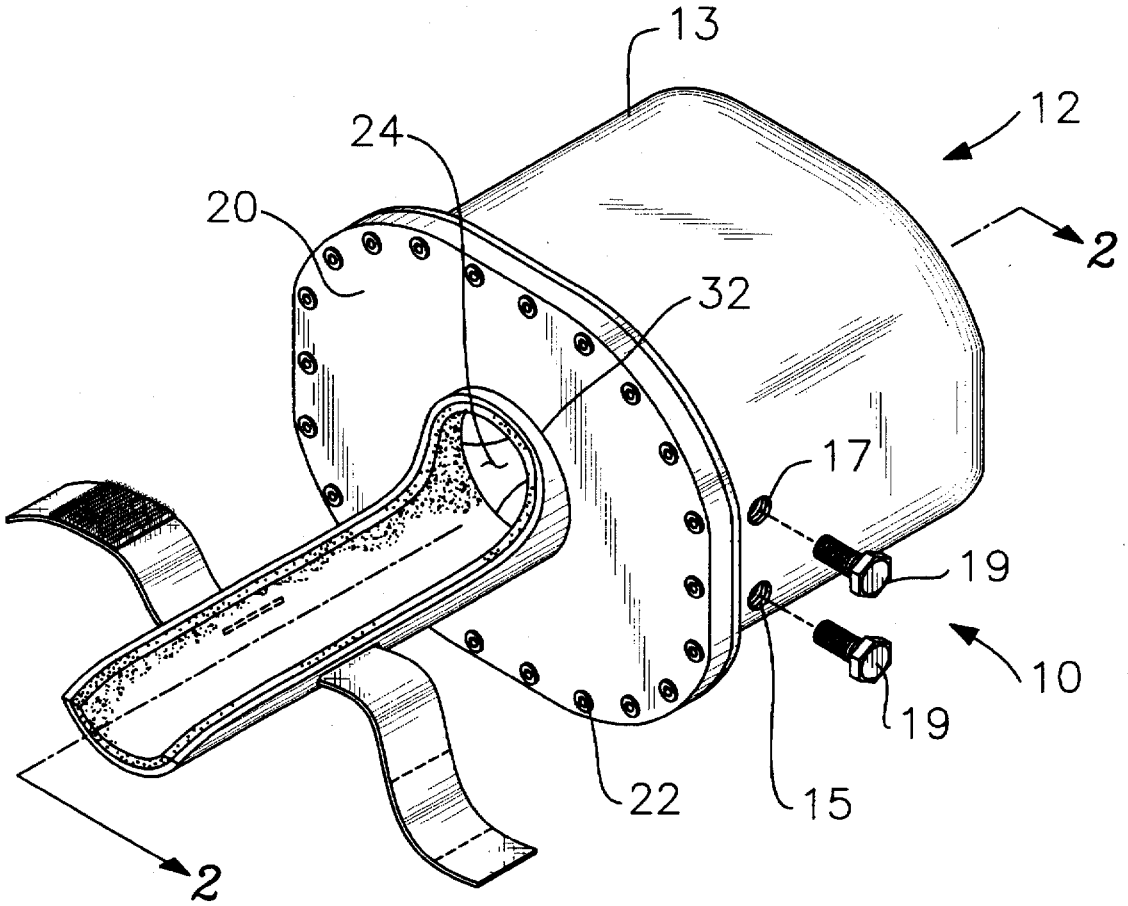
FIG. 1 is a pictorial view of one embodiment of the subject invention.
Figure 2:
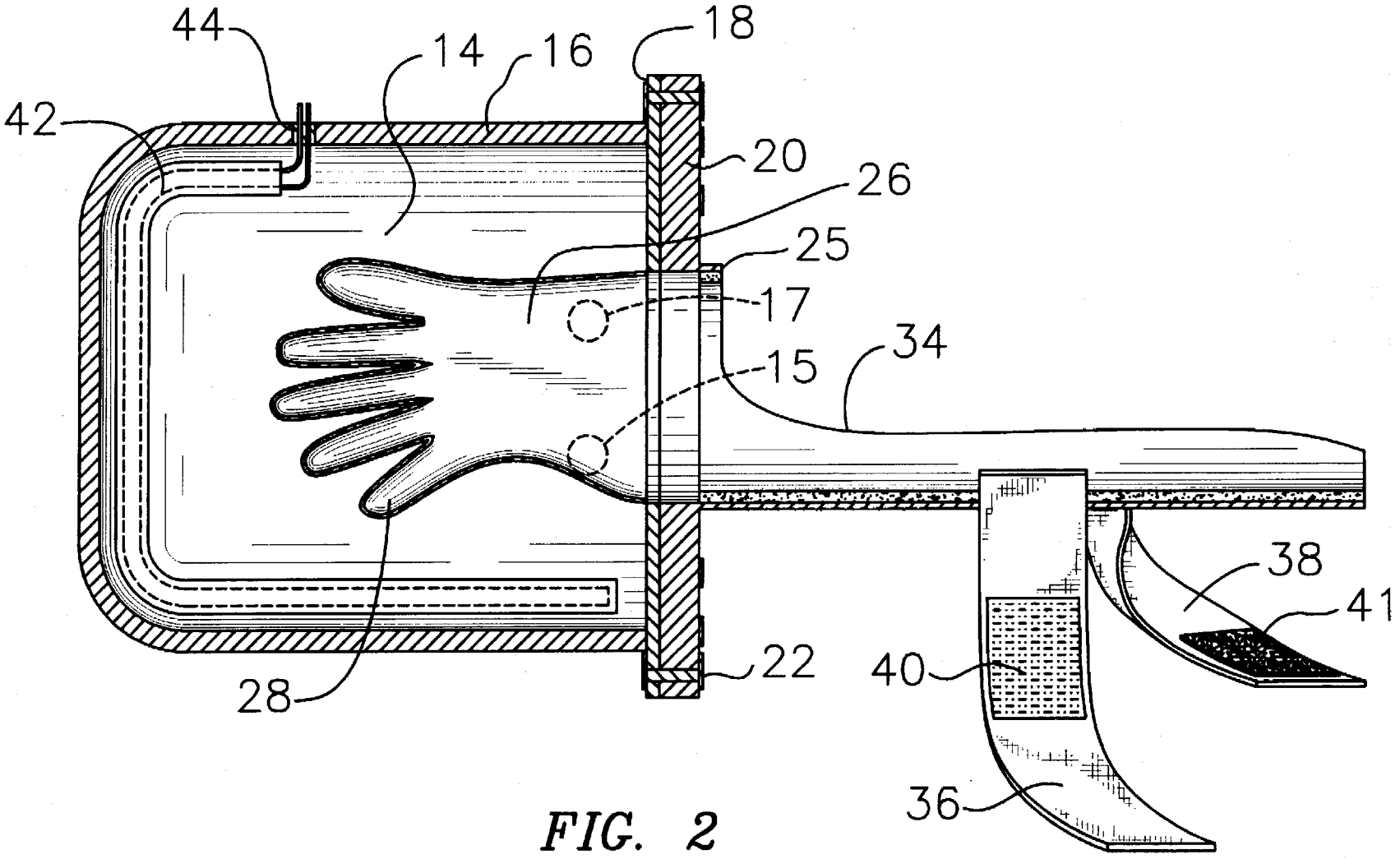
FIG. 2 is a side elevational view of the apparatus of FIG. 1 showing a portion of the apparatus in section.

Referring now more particularly to FIG. 1, there is provided limb exerciser/therapy apparatus 10 which in this embodiment is particularly adapted for use in exercise/therapy for the hand and arm. Apparatus 10 includes container 12 forming an interior space 14, as shown in FIG. 2. Container 12 includes tub 13 having wall 16 which is, in the embodiment, approximately ¼ inch thick and is preferably made of fiberglass. Container 12 includes circular lip 18. Face plate 20, which is preferably transparent, may be made of plexiglass, is attached to circular lip 18 by means of bolts 22. A circular gasket (not shown) may be placed between lip 18 and outer periphery of the face plate 20 to inhibit leaks.

Figure 3:
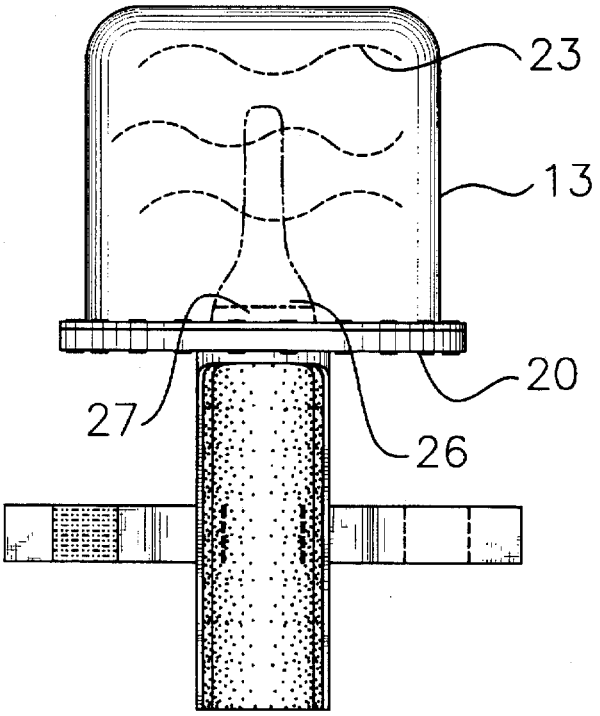
FIG. 3 is a top view of the apparatus of FIG. 1 showing the glove in phantom.

The interior space 14 of container 12 is filled with a viscous material generally indicated by the wavy lines 23, as shown in phantom in FIG. 3. Preferably, the viscous material is a mixture of solids and liquids and the preferred embodiment is a mixture of cornstarch and water. Also, preferably, a suspending agent, such as xanthan gum, is added to the cornstarch and water so that the cornstarch particles do not readily settle out. In addition, in the preferred embodiment, an antibacterial agent is added to the cornstarch and water to prevent the organic mixture from spoiling. Preferably, the antibacterial agent is Sodium Azide. The preferred formulation for the viscous material by percent weight is 49% water, 50% cornstarch, less than 1% xanthan gum and less than 1% sodium azide. The purpose of the viscous material is to provide resistance to motion, as will be explained below.

Face plate 20 includes a opening 24 therein which receives the circular portion 25 of platform 34. Circular portion 25 is sealed in opening 24 by glue. A lip 27 is formed by the extension of circular portion 25 into interior space 14. Sheath 26, which in the preferred embodiment is in the form of a universal glove, that is, a glove which will fit either the left or the right hand, extends into interior space 14 from opening 24. The distal portion 28 of glove 26 is in a shape to conform to a thumb and four fingers. The proximal portion of the glove 30 is tubular and thus round in cross-section and is attached to lip 27 by means of a hose clamp (not shown). Thus the glove itself forms a seal since the proximal end of the glove, in effect, seals the opening 24. The lip 27 may be glued to the face plate to secure it thereto. Preferably the glove is made of a latex material.

A platform 34 in the form of a curved armrest extends away from opening 24. The platform may be glued to a portion of rim 32. A pair of straps 36 and 38 are attached to the armrest. The straps include a pair of Velcro® fasteners 40 and 41 so that the person's arm may be secured to the armrest during exercise and/or therapy.

In the preferred embodiment, electrical heating tape 42 is received in the interior space 14 of the container 12 for heating the viscous material. The warmth of the viscous material provides a therapeutic effect for an injured hand by stimulating blood flow. An electrical connector 44 penetrates the wall 16 of the container so that the heating tape may be connected to a source of electrical power (not shown).

Figure 4:
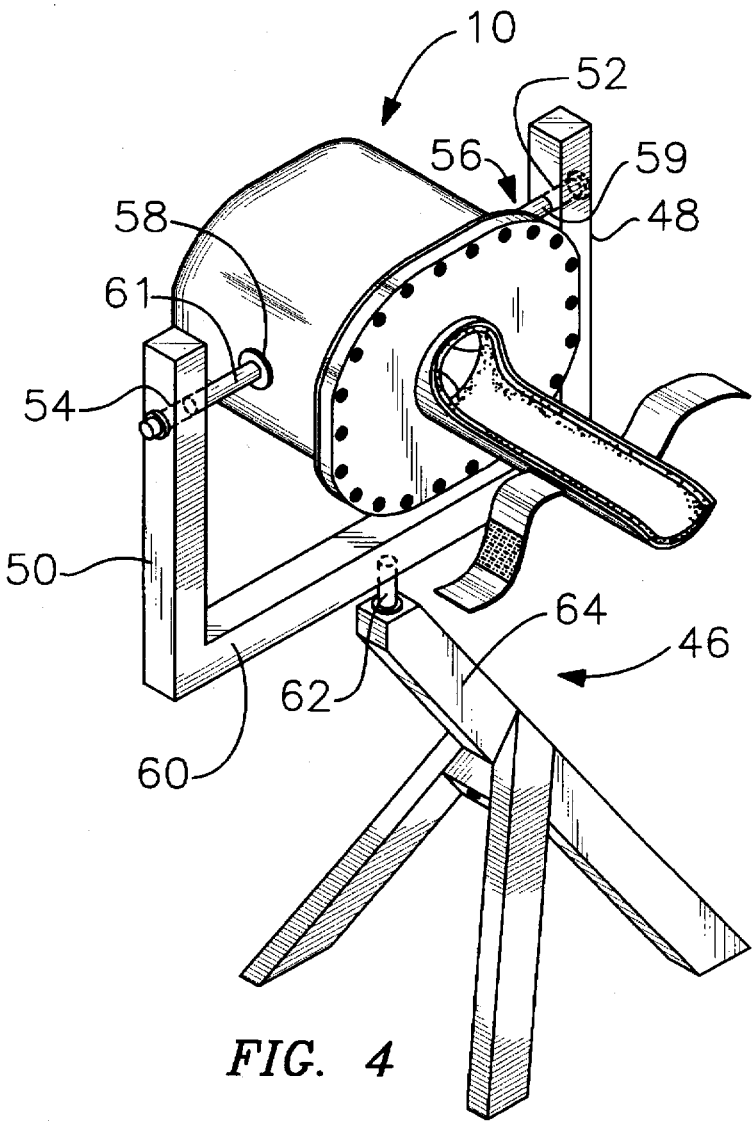
FIG. 4 is a pictorial view showing the apparatus of FIG. 1 mounted on a support member.

Referring now more particularly to FIG. 4, apparatus 10 is mounted on frame 46. Frame 46 includes a pair of arms 48 and 50 having holes 52 and 54 therein. Attachment plates 56 and 58 are connected to the walls of the tub 13 by means of bolts (not shown). Rotatable rods 59 and 61 extend from the attachment plates through holes 52 and 54. Horizontal beam 60 connects arm 48 to arm 50. Swivel 62 connects horizontal beam 60 to tripod 64. Thus apparatus 10 may be rotated in the axial direction by means of rotatable rods 59 and 61 so as to provide a height and position adjustment which is suitable for a particular user. In addition, the upper part of frame 46, and thus apparatus 10, may also be rotated through the use of swivel 62.

Figure 5:
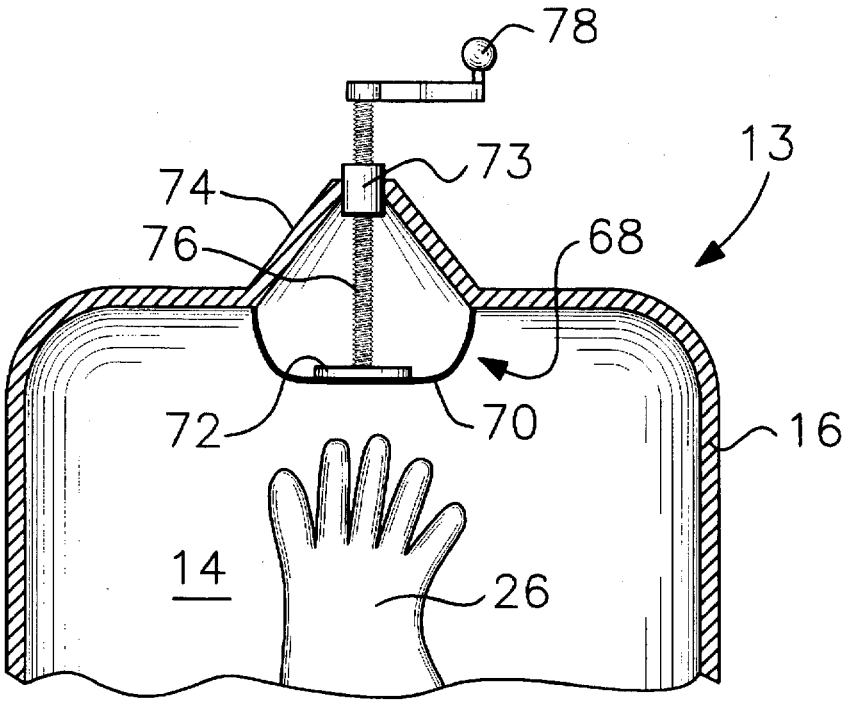
FIG. 5 is a partial top view of an alternative embodiment of the container portion of the apparatus of FIG. 1 at high pressure.
Figure 6:
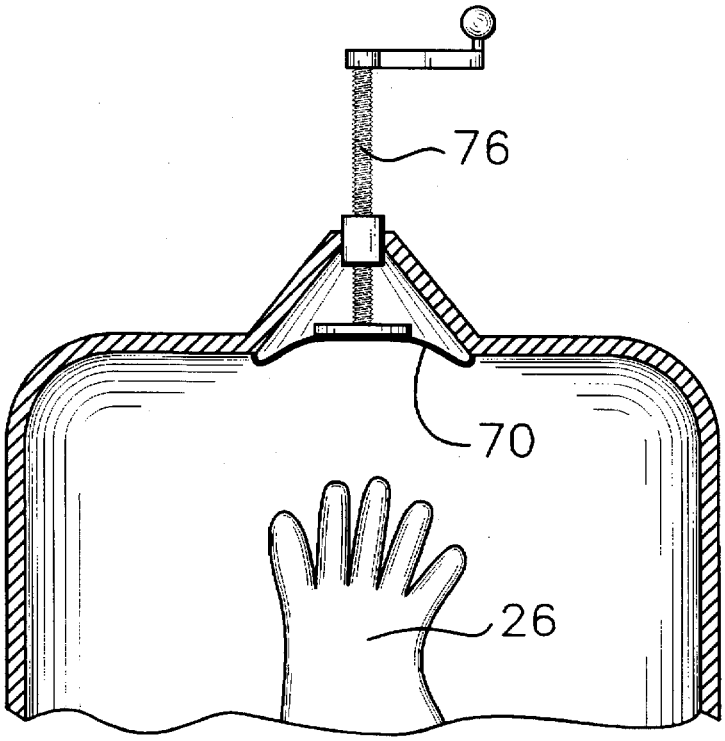
FIG. 6 is a partial top view of the apparatus of FIG. 5 but at low pressure.
Figure 7:
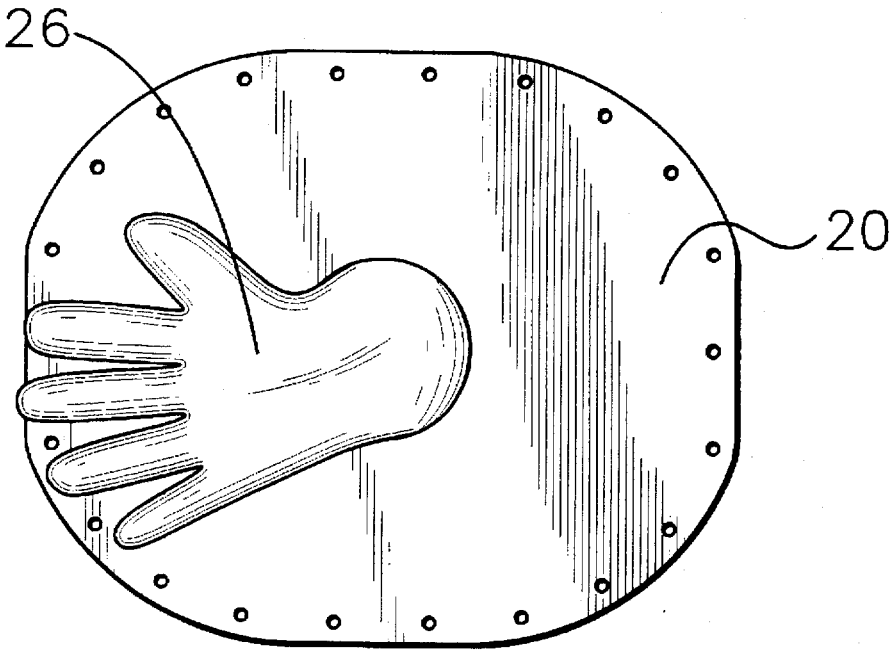
FIG. 7 is a pictorial view showing the inside of the face plate which forms part of the container.
Figure 8:
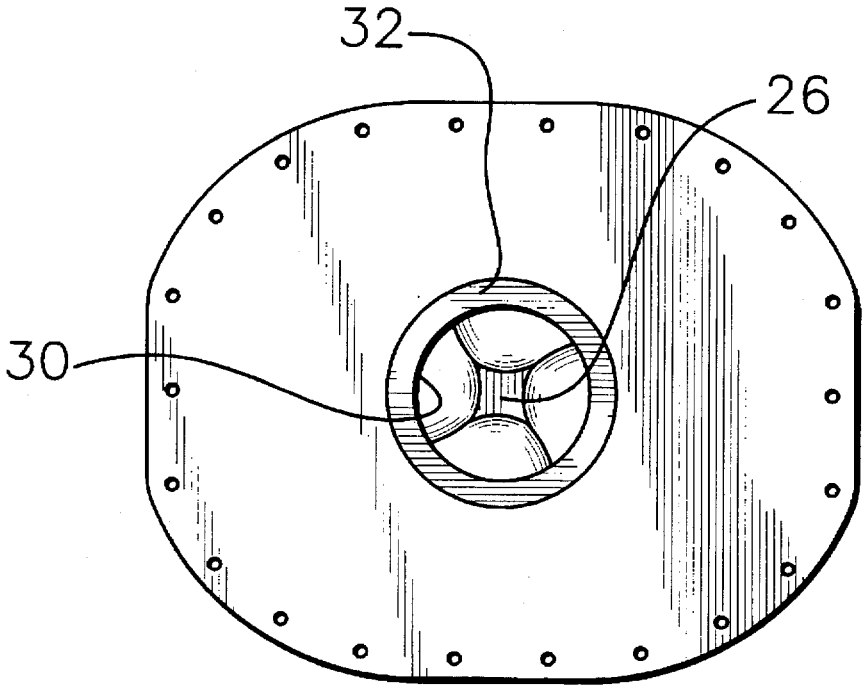
FIG. 8 is a pictorial view of the outside of the face plate which forms a part of the container.

FIG. 5 shows an alternative embodiment of the invention, whereby the pressure inside container 12, and thus the size of glove 26, may be somewhat regulated. In the embodiment of FIG. 5, a second hole 68 is provided in wall 16 of tub 13. A flexible diaphragm 70 covers the inside of hole 68 and is attached to periphery of hole 68 by glue. A rigid plunger 72 contacts the diaphragm. A scaffold 74 is received over the outside of hole 68 and is attached to the outside of wall 16 by glue. A threaded rod 76 passes through a threaded nut 73 which forms part of the scaffold 74. Threaded rod includes handle 78 for ease of rotation. Rod 76 is attached to plunger 72. By rotating the threaded rod in one direction, the diaphragm 70 may be pressed by the plunger inwardly into the interior space 14 so as to increase the pressure on the viscous material 23, thereby causing the volume or size of the glove 26 to decrease. Correspondingly, as shown in FIG. 6, by rotating the rod 76 in the other direction, the diaphragm 70 moves outwardly and the pressure on the viscous material will decrease, thereby permitting the glove to expand in size. This alternative embodiment enables the glove size to be made more universal.

Referring again now to FIGS. 1 and 2, filler hole 15 and air hole 17 are received in tub 13. Each of these holes is opened and closed by means of set screw 19. The viscous material is inserted into tub 13 through filler hole 15 and the air escapes through hole 17. The filler hole and air hole also helps one to "inflate" the glove 26. After the viscous material has been placed into tub 13, it is necessary to displace sufficient viscous material as to create a vacuum like state. This is done by forcing the assembler's hand into the glove in the inside of tub 13, which thereby pushes an equal volume of viscous material out of a filler hole 15 or air hole 17, depending on which one is open. The tub is then sealed in this negative viscous material pressure state by placing set screws 19 into holes 15 and 17, thereby permitting the glove to maintain its inflation.

The hand exercise/therapy apparatus described above may be operated as set forth below.

The glove 26 is pressed in contact with the viscous material in interior space 14. If the apparatus is equipped with the heating tape 42, plug 44 is connected to a source of electrical power so that the viscous material 23 is heated up.

The user then places his hand inside of glove 26 and rests his forearm on platform 34. His forearm is secured to platform 34 by means of straps 36 and 38. The user then moves his hand to the right, to the left, up and down squeezing the viscous material, working his fingers out and in, forming a fist and then an open palm, and any other kind of exercise which may be deemed appropriate for the exercise or therapy required. Once the exercise of one hand is completed, the user may then place his other hand in the glove and the exercise is repeated if desired. The faster the person attempts to move his hand through the viscous material, the more resistance to the movement is applied. Thus the user may self-regulate the amount of resistance in the exercise.

Thus there is provided an easy to use hand exercise/therapy apparatus. The invention is not limited to the exercise of the hand. One may utilize the invention to exercise other limbs, such as the legs and feet.

From the foregoing description of the preferred embodiment of the invention, it will be apparent that many modifications may be made therein. It will be understood, however, that this embodiment of the invention is an exemplification of the invention only and that the invention is not limited thereto. For example, other viscous materials besides a mixture of cornstarch and water may be used. It is to be understood therefore that it is intended in the appended claims to cover all modifications as fall within the true spirit and scope of the invention.

I claim:

1. A limb exercise/therapy apparatus comprising:

a sealed container having an interior space; said container having an opening therein;

a sheath attached to said container only near said opening and extending from said opening into said interior space; said sheath forms an enclosed volume adapted to receive a limb; said sheath permitting said limb to move freely within said interior space of said container;

a viscous material received in and substantially filling said interior space; said viscous material providing resistance to the movement of the limb wherein a user inserts a limb into said sheath and performs movements against the resistance of said viscous material while said sheath protects the limb from coming into direct contact with said viscous material.

2. An apparatus as set forth in claim 1, wherein said viscous material is a solid and liquid mixture.

3. An apparatus as set forth an claim 2, wherein said viscous material is a mixture including cornstarch and water.

4. An apparatus as set forth in claim 3, further including a suspending agent in said mixture.

5. An apparatus as set forth in claim 4, wherein said suspending agent is xanthan gum.

6. An apparatus as set forth in claim 5, wherein said mixture further includes an antibacterial agent.

7. An apparatus as set forth in claim 6, wherein said antibacterial agent is sodium azide.

8. An apparatus as set forth in claim 1, further including a platform extending from said opening to the outside of said interior space for supporting a part of the limb which is not received in said sheath.

9. An apparatus as set forth in claim 8, wherein said platform is curved.

10. An apparatus as set forth in claim 8, wherein said platform has at least one strap attached thereto to secure the limb to said platform.

11. An apparatus as set forth in claim 8, wherein a portion of said platform extends through said opening; said portion of said platform being in the shape of a round hollow pipe; said proximal portion of said sheath attached to said pipe shaped portion of said elongated member.

12. An apparatus as set forth in claim 1, wherein the limb is a hand and said sheath is a glove.

13. An apparatus as set forth in claim 12, wherein said glove includes a distal portion for receiving the hand and a proximal portion attached about said opening in said container.

14. An apparatus as set forth in claim 1, further including a heat source for heating said material.

15. An apparatus as set forth in claim 14, wherein said heat source is electrical heating tape received in said interior space.

16. An apparatus as set forth in claim 1, further including a support member; said container received on said support member; said support member elevating said container; said support member including a pivot member, whereby said container may be rotated.

17. An apparatus as set forth in claim 1, further including a second opening in said container, a flexible diaphragm covering said second opening; a plunger; said plunger being in contact with said diaphragm and capable of moving said diaphragm, thereby changing the pressure inside said interior space.

18. An apparatus set forth in claim 17, further including a scaffold located on the outside of said container over said second opening; a threaded rod; said threaded rod connected to said plunger and to said scaffold.

19. A hand exercise/therapy apparatus comprising:

a sealed container having an interior space; said container having an opening therein;

a glove attached to said container only near said opening and extending from said opening into said interior space; said gloved forms an enclosed volume adapted to receive a hand; said glove permitting the hand to move freely within said interior space of said container;

a viscous material received in and substantially filling said interior space; said viscous material providing resistance to the movement of hand;

a platform extending from said opening away from said container; said platform adapted to support the user's forearm wherein a user inserts a limb into said glove and performs movements against the resistance of said viscous material while said glove protects the limb from coming into direct contact with said viscous material.

* * * * *